United States Patent [19]

Young et al.

[11] 4,425,121

[45] Jan. 10, 1984

[54] ADJUSTABLE FEEDING DEVICE FOR THE ADMINISTRATION OF DOSAGES OF GELS AND PASTES TO FARM ANIMALS

[75] Inventors: William E. Young, Monmouth; William R. Pasco, Bricktown, both of N.J.

[73] Assignee: American Cyanamid Company, Stamford, Conn.

[21] Appl. No.: 351,065

[22] Filed: Feb. 22, 1982

[51] Int. Cl.[3] ..... A61D 7/00

[52] U.S. Cl. ..... 604/209

[58] Field of Search ..... 128/236, 218 C, 234, 128/215, 223, 224; 222/309, 391

[56] References Cited

U.S. PATENT DOCUMENTS

| | | | |
|---|---|---|---|
| 1,672,421 | 6/1928 | Negley | 222/391 |
| 3,504,673 | 4/1970 | Parisi | 222/309 |
| 3,517,668 | 6/1970 | Brickson | 222/309 X |
| 4,090,639 | 5/1978 | Campbell et al. | 222/309 X |
| 4,185,755 | 1/1980 | Sachs et al. | 222/309 X |
| 4,339,058 | 7/1982 | Wendt | 222/309 |

*Primary Examiner*—John D. Yasko

*Attorney, Agent, or Firm*—Thomas J. Monahan

[57] ABSTRACT

An animal feeding device which accepts cartridges containing various gels, pastes, or other similar materials. This device is useful for the oral administration of feeds or medicants to farm animals, especially cattle, in adjustable dosages to fit the individualized needs of animals under treatment.

7 Claims, 6 Drawing Figures

Figure 1:
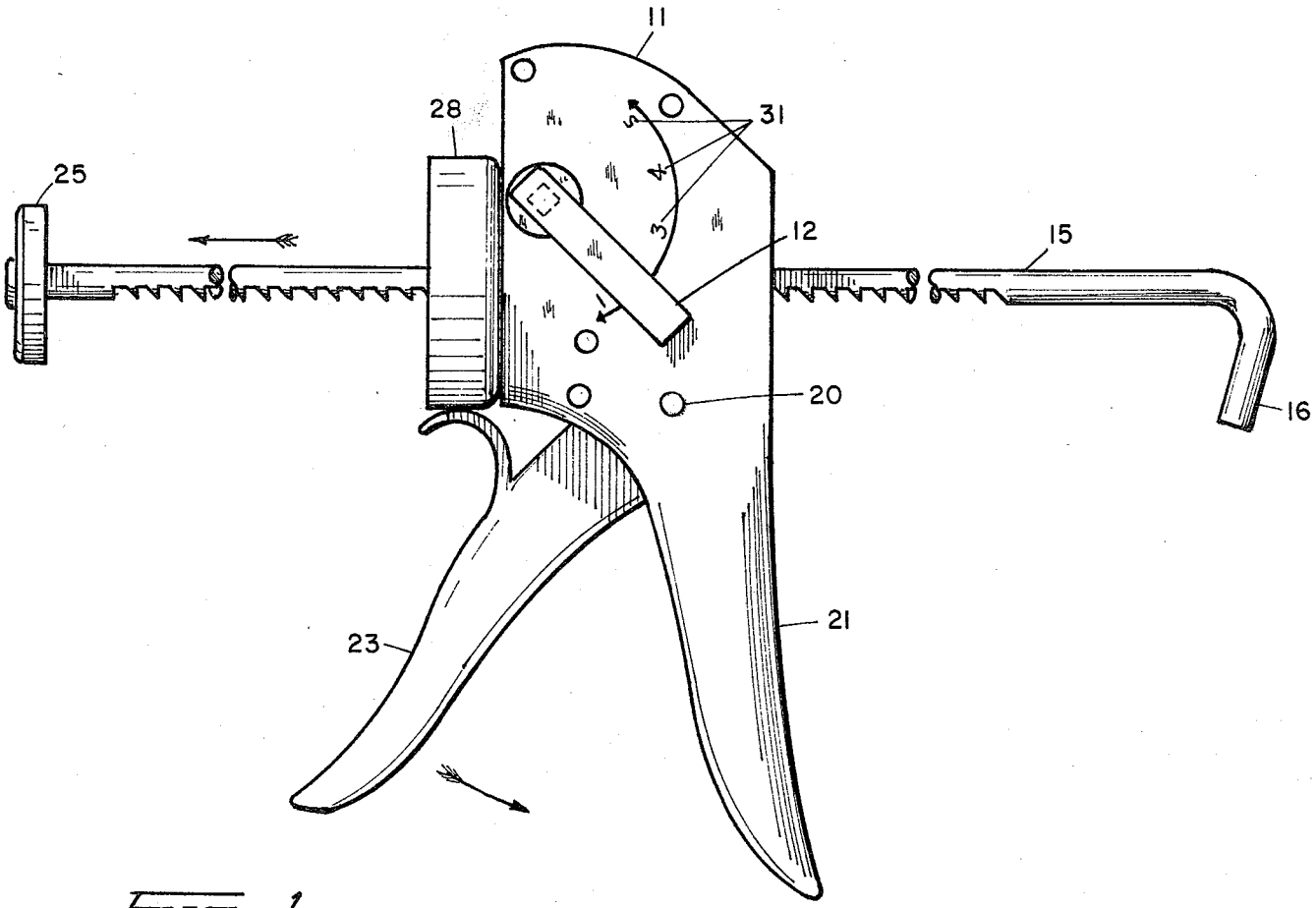

ADJUSTABLE FEEDING DEVICE FOR THE ADMINISTRATION OF DOSAGES OF GELS AND PASTES TO FARM ANIMALS

The invention herein described relates to a new apparatus for easily feeding animals measured oral doses of various medicated gels, pastes or other similar preparations. This device uses an adjustable regulator for accurately modifying feed dosages to farm animals, especially cattle, in order to meet the individualized requirements of animals under treatment.

By way of background, medicated gels and/or pastes which can be utilized in the presently described feeding device are known in the art. For example, a particularly well-suited gel is disclosed in U.S. Pat. No. 4,287,176 (1981). Various drugs and medications, such as levamisole-tetramisole salts, formulated as gels and/or pastes may be accurately and rapidly administered to farm animals (i.e., cattle) in predetermined dosages by use of the feeding device of the invention. A multiple dose paste dispenser is described in U.S. Pat. No. 3,894,663 (1975).

Farm animals are routinely treated with drugs in order to minimize, prevent or cure infectious diseases of microbial origin, to combat infestation by parasites, or to promote animal growth. Such drugs usually are administered orally to animals as feed additives, or are dissolved in their drinking water, or given to animals as OBLETS®, tablets, boluses, capsules or other similar preparations. Though most of the above formulations offer certain advantages, they also suffer from potentially serious drawbacks. For example, medications offered in the feed or drinking water of an animal may not be ingested in the required dosage if the animal under treatment consumes less feed and/or drinks less water than was expected. Tablets, OBLETS®, capsules and the like allow a more precise metering of medications, but dosages are usually large. As a result, it is not easy to adjust dosages to suit the animal's weight, and they are also more time consuming and more difficult to administer to animals. Pour-ons, while easily administered, represent a rather inaccurate method for the delivery of feeds, drugs, or other medicants. Injectables are well suited for the delivery of precise dosages of medications, but they may be difficult to administer and may cause tissue damage at the site of the injection.

In light of the foregoing summary of some demands and limitations of conventional materials and methods for delivering various feeds, drugs or medicinals to farm animals, an improved method or device for accomplishing such objectives is highly desirable. An object of this invention is to provide a new and useful device which can be used for the rapid and accurate oral administration of various preparations of feeds, drugs or other medicinals to farm animals. This object is manifest in the following description and particularly delineated in the appended claims.

It has been discovered that by using the feeding device of the present invention, (c.f., FIG. 1), a desired material, formulated as a gel or paste, may be administered with great ease and precision to animals with minimal or no discomfort.

Conveniently, a cartridge, holding a plurality of dosages of a medicated gel or paste is attached to the feeding device, (FIG. 1), via a bayonet mount (cartridge and bayonet mount are not shown). Prior to use, the dosage is set by turning a cam bracket (not shown in FIG. 1) via turn handle knob(s) (12) to the appropriate dosage calibration marking (31) located on the side of the gun housing (11). The tip of the cartridge is then inserted into the side of the animal's mouth between its teeth, and the movable handle (23) is pulled back against stationary handle (21) until it (23) comes to a full stop and the required dosage of the medicated gel or paste is discharged into the animal's mouth.

That the feeding device of the present invention (FIG. 1) and its method of operation may be more thoroughly explained and illustrated, the following detailed description is given.

The invention is hereinafter described with reference to the accompanying drawing in which:

FIG. 1 is a diagram of an animal-feeding device; and

Figure 2:
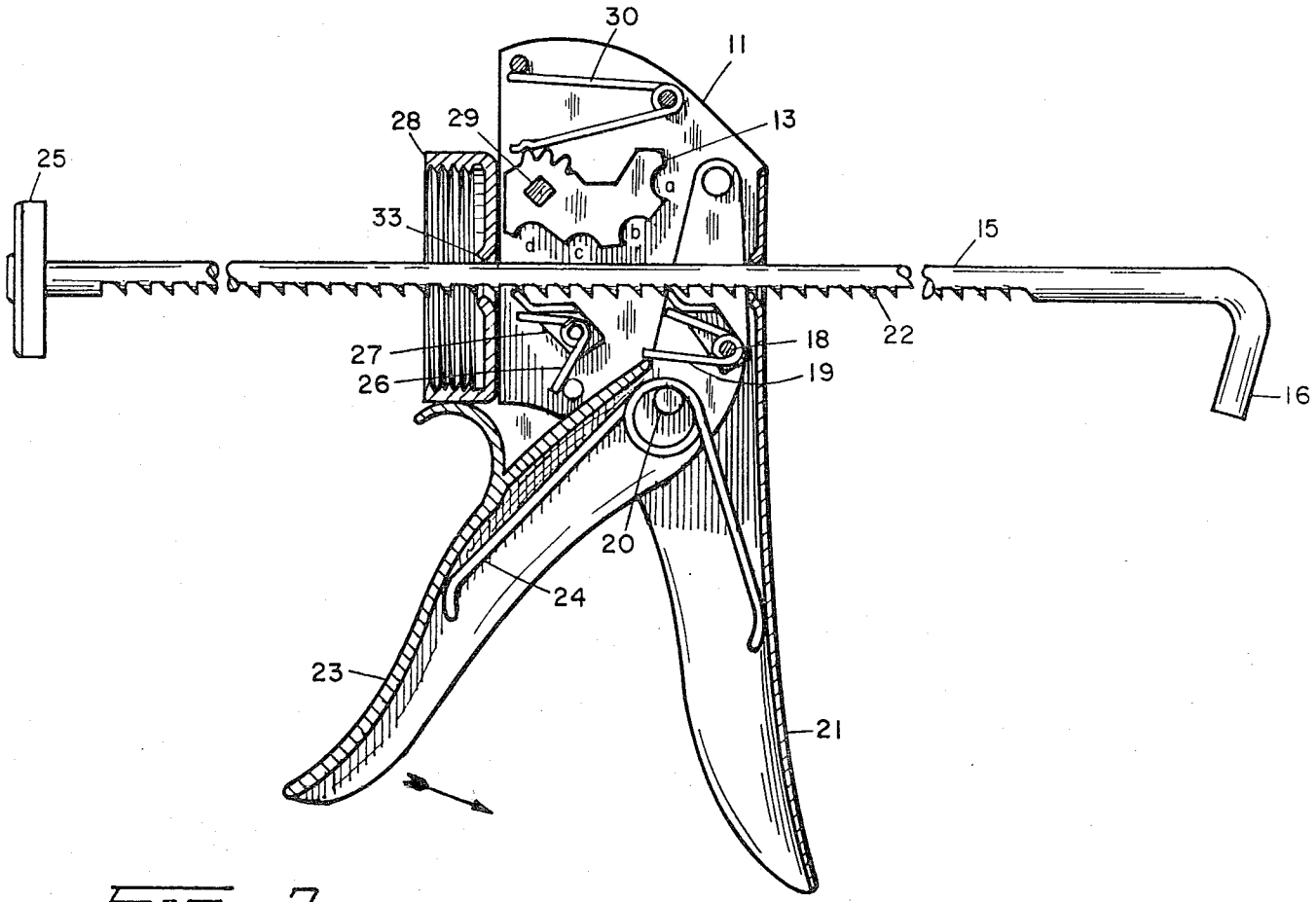
Figure 3B:
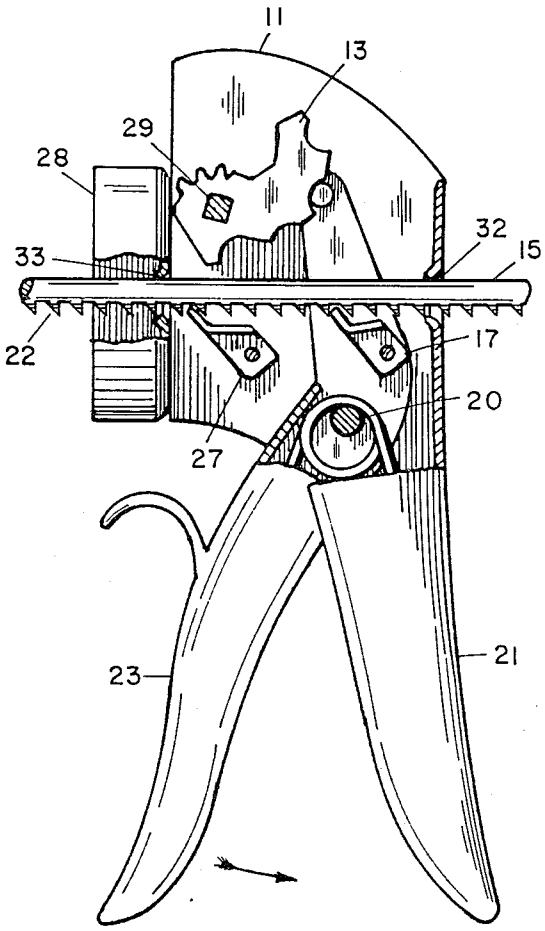
Figure 3A:
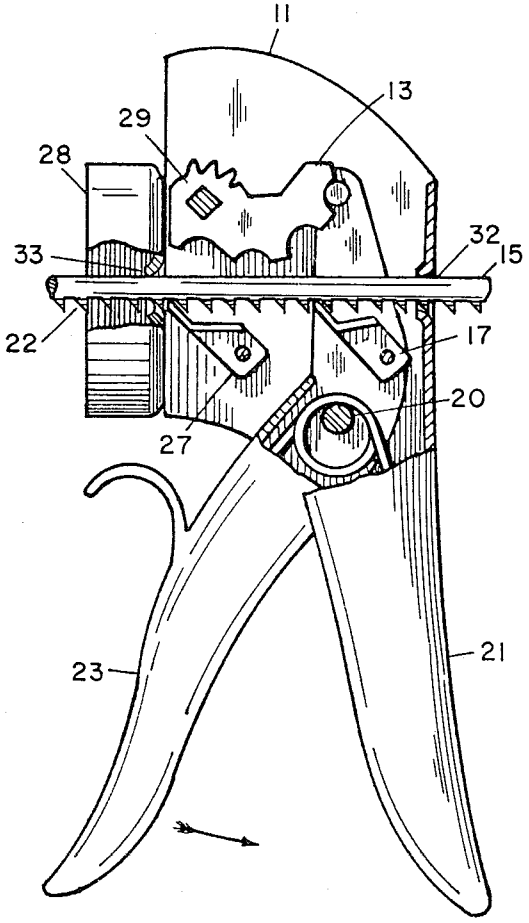
Figure 3D:
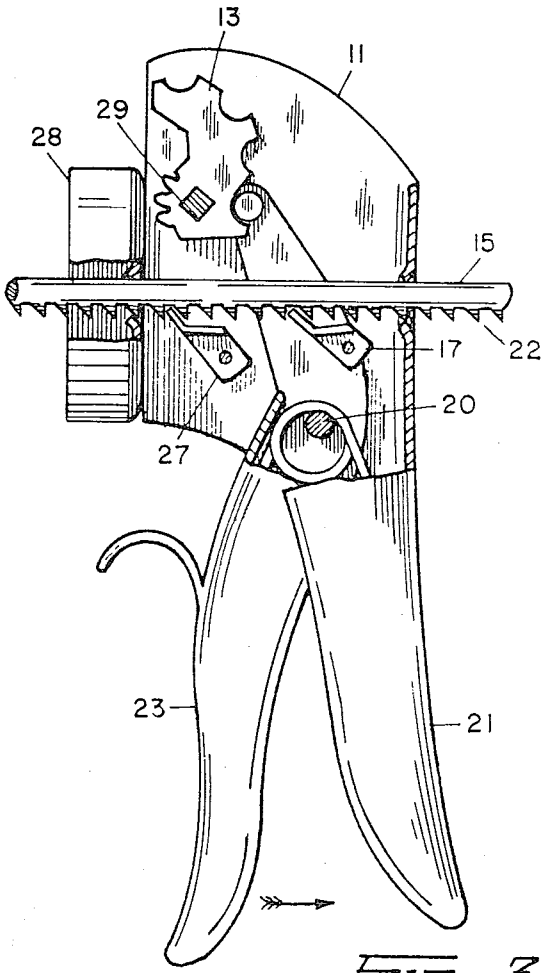
Figure 3C:
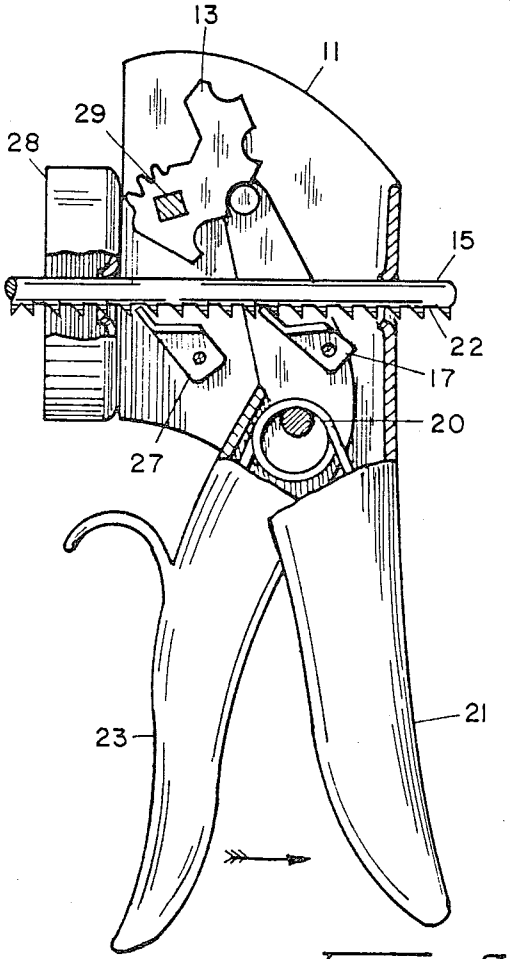

FIG. 2 presents a longitudinal section of this animal-feeding device; and

FIGS. 3*a*, 3*b*, 3*c*, and 3*d* show partially-whole and partly-longitudinal enlarged section diagrams of the main body of the invention at different dosage settings.

Turning now to FIG. 2, an animal-feeding device is shown comprising: a housing (11), a stationary handle (21), and an internally threaded cup (28) which together form one integral unit, shaped so as to accept and enclose a cam bracket (13) which is provided with semicircular depressions (labelled a to d) corresponding to the dosages the gun is capable of delivering and wherein the size of units (of medications) increases from a to d, a cam bracket (13) is held by a cam bracket spring (30) at the dosage setting selected, and said cam bracket (13) is attached to and rotatable in an arc around a square cam bracket shaft (29). The cam bracket shaft (29) emerges through and is supported by bearings (not shown) on both sides of the housing (11) and is terminated in the turn handle knobs (12). The aforesaid cam bracket (13), cam bracket shaft (29), and turn handle knobs (12) form one integral unit being held in place at the selected setting by a cam bracket spring (30). A set of numbers (31), corresponding to the individual dosages the device is capable of delivering as one unit, is marked on both sides of the housing (11) along an arc, which has the cam bracket shaft (29) at its center, and a radius sufficiently large so as to allow the alignment of the free end of the turn handle knobs (12) with the dosage indicating numbers (31). A movable handle (23) is attached to a housing (11) via a movable handle shaft (20), which is held under tension and away from the stationary handle (21) by a main spring (24). A pawl (17) is attached to a movable handle (23) via a pawl shaft (18) which is held against a ratchet (22) by a pawl spring (19). A ratchet (22) comprising a plurality of inclined teeth traverses the longitudinal axis of the plunger-rod (15). The plunger-rod (15) coincides with the longitudinal axis of the housing (11), emerges through and is supported by front (33) and rear (32) bearings. The front end of said rod (15) is terminated by a plunger (25), while the rear end of said rod is shaped to form a handle (16). An arresting pawl (27) pivots around a shaft (not shown) and is held against the ratchet (22) by a pawl spring (26) which serves to prevent the backward motion of the plunger (25) and plunger-rod (15) while the animal-feeding device is in use.

In preparation for use of the invention a compressible ring-shaped gasket is placed on the bottom of the internally threaded cup (28) and a cartridge bayonet mount (not shown) is then screwed into this cup (28) until firmly seated against the gasket.

Next, the unit comprising: plunger (25), plunger-rod (15), handle (16) and ratchet (22) is rotated around its longitudinal axis until the ratchet (22) is disengaged from the pawls (17 and 27). The unit is then pulled back and rotated again to reengage the ratchet (22) and pawls (17 and 27). A cartridge (not shown), holding a plurality of dosages of a gel or paste or other similar feed material is then affixed to the feeding device via the above-mentioned bayonet mount.

The required dosage is then set by rotating the turn handle knobs (12) until they are aligned opposite the desired dosage number (31), wherein this rotation is transferred by the cam bracket shaft (29) to the cam bracket (13) so as to bring the appropriate semicircular depression (a to d) in position to receive the pin (14) affixed to a movable handle (23) and thereby arrest the motion of same at the end of a dosage delivery cycle. Since at this point the pin (14) and the cam bracket shaft (29) are in line, the stopping force is transmitted in its entirety to the cam bracket shaft (29) rather than to the cam bracket spring (30).

The animal-feeding device (FIGS. 1 and 2) is thus loaded and set. The nozzle of the cartridge is then inserted into the side of the animal's mouth between its teeth, and the movable handle (23) is pivoted around the shaft (20) towards the stationary handle (21), as by squeezing, while the main spring (24) is simultaneously compressed. As the movable handle (23) pivots around the shaft (20) this swing is translated by the pawl (17) into a linear forward motion. Since the pawl (17) is held against the ratchet (22) by a spring (19), this forward motion is simultaneously communicated by said pawl (17) to the ratchet (22), resulting in the forward motion of the plunger-rod (15) and plunger (25) attached thereto. Moving forward, the plunger (25) pushes a piston-seal built into the cartridge which contain the feed. Thus, the forward movement of the piston-seal forces the appropriate volume of feed (i.e., medicated gel or paste) through the nozzle of the cartridge into the animal's mouth. The delivery of the dosage is completed when the appropriate semicircular depression (a to d) of cam bracket (13) receives the pin (14) affixed to movable handle (23) and the motion of same around shaft (20) is thereby arrested. When the movable handle (23) is released at the end of the cycle, the compressed mainspring (24) returns same to the starting position, and the animal-feeding device is now ready for the delivery of another similar dose, or if the cam bracket (13) is reset, for the delivery of a dose of a different unit. The volume of the feed is determined by the inner diameter of the cartridge (constant) and the length of travel of plunger (25), wherein the length of travel of said plunger (25) is dependent on the cam bracket (13) setting (a to d).

The diagram presented in FIG. 2 shows the animal-feeding device in the starting position with the cam bracket (13) set at a along with the appropriate setting of the turn-handle knobs (12).

Partial diagrams (FIGS. 3*a* to 3*d*) show the invention at the end of a delivery cycle at each of the dosage settings labelled a to d (or 2 to 5).

The invention is further illustration by the nonlimiting example set forth below.

EXAMPLE 1

Determination of the accuracy of the dosing gun at various dosage settings.

The animal-feeding device is filled with a cartridge loaded with a gel containing 11.5% by weight of levamisole hydrochloride. At the above concentration 3.155 g gel is required per 100 lb body weight to administer said drug at the rate of 8 mg/kg body weight of animal (100 lb=45.359 kg).

At each dosage setting, ten individual dosages are dispersed by the dosing gun, each dosage is weighed and the average of the ten dosages and the deviation of the average from the theoretically required amount of gel are determined. Results of this experiment are presented in Table I. These data demonstrate that the animal-feeding device of the invention is capable of delivering a preselected dosage of a medicated gel (or paste) with acceptable accuracy.

TABLE I

| | Accuracy of the animal-feeding mechanism at various dosage settings* | | | |
|---|---|---|---|---|
| No. | 200 lbs | 300 lbs | 400 lbs | 500 lbs |
| 1 | 6.24 | 9.52 | 13.00 | 16.12 |
| 2 | 6.38 | 9.55 | 12.90 | 16.07 |
| 3 | 6.38 | 9.75 | 12.99 | 16.09 |
| 4 | 6.34 | 9.43 | 12.93 | 16.16 |
| 5 | 6.33 | 9.86 | 12.91 | 16.09 |
| 6 | 6.41 | 9.51 | 13.12 | 16.07 |
| 7 | 6.44 | 9.55 | 12.72 | 16.04 |
| 8 | 6.31 | 9.60 | 12.95 | 16.31 |
| 9 | 6.37 | 9.62 | 12.85 | 16.09 |
| 10 | 6.40 | 9.63 | 12.62 | 16.00 |
| Average | 6.36 | 9.60 | 12.90 | 16.09 |
| Theory | 6.31 | 9.46 | 12.62 | 15.77 |
| % Deviation | +0.79 | +1.48 | +2.22 | +2.03 |

*Data indicates dosages dispersed by the device corresponding to amounts required for various animal weights

What is claimed is:

1. An animal-feeding device for orally delivering a plurality of measured doses of gels, pastes or other similar preparations, which may be medicated, comprising: a housing, an externally-attached feed-containing cartridge, an injecting means, a propelling means, and an adjustable dosage regulator wherein said adjustable regulator has a pivotally-attached notched cam, an adjusting knob firmly attached to said pivot and a pivotally-attached spring; the terminal end of said spring can be movably fixed in said cam notches located distally to the longitudinal axis of said injecting means, and cam notches located proximally to said injecting means serving to regulate said propelling means by selectively affecting said propelling means.

2. An animal-feeding device according to claim 1 wherein said injecting means comprises a plunger-rod having a plurality of inclined teeth which traverse the rod along a longitudinal surface and serve as a ratchet, and the front end of said plunger-rod is terminated by a plunger which fits into said feed cartridge while the rear end of said plunger-rod forms a handle; said plunger-rod passes through said housing and is supported by front and rear bearings where said plunger-rod makes contact with said housing and is freely rotatable and movable therethrough; said plunger-rod is powered by said propelling means.

3. An animal-feeding device according to claim 2 wherein said propelling means comprises a handle pivotally-attached to said stationary handle of said housing, a spring which passes over said pivotal attachment locus and one end of said spring contact said pivotally-attached handle while the other end of said spring contacts the stationary handle; said pivotally-attached handle contains a pivotally-attached pawl which contacts said ratchet of said plunger-rod and a pawl spring which traverses said pivotal attachment locus of said pawl and one end of said pawl spring contacts said pivotally-attached handle while the other end of said pawl spring contacts the pawl; and a stationary pin located in and at right angles to the end of said pivotally-attached handle which engages in the notches of said cam of said adjustable regulator.

4. An animal-feeding device according to claim 3 wherein said pivotally-attached handle is obliquely carved from the locus of the pivotally-attached pawl to the end of said pivotally attached handle containing the stationary pin and angled toward the notches of said cam of said adjustable regulator.

5. An animal-feeding device according to claim 4 wherein said housing has an internally-threaded cartridge-accepting cup, a stationary handle, a pivotally-attached pawl which contacts said plunger-rod or said injecting means and a pawl spring which traverses said pivotal attachment locus of said pawl; one end of said pawl spring contacts said pawl while the other end of said pawl spring contacts a stationary stop pin attached to said housing, and said housing accepts the propelling means, injecting means, and adjustable regulator.

6. An animal-feeding device according to claim 5 wherein said feed-containing cartridge is a tubular structure with one end attenuated forming a nozzle and the other end of said cartridge having ridges for attachment to said internally-threaded housing cup by an externally-threaded bayonet mount.

7. An animal-feeding device for orally delivering a plurality of measured doses of gels, pastes, or other similar preparations, which may be medicated, having a means for injecting said feed and means for propelling said injecting means, the improvement comprising: an adjustable regulator having a pivotally-attached notched cam, an adjusting knob firmly attached to said pivot and a pivotally-attached spring; the terminal end of said spring can be movably fixed in said cam notches located distally to the longitudinal axis of said injecting means, and cam notches located proximally to said injecting means serving to regulate said propelling means by selectively restraining said propelling means.

* * * * *